US009115480B2

(12) United States Patent
Tack

(10) Patent No.: US 9,115,480 B2
(45) Date of Patent: Aug. 25, 2015

(54) CUTTER HEAD FOR DREDGING GROUND AND METHOD FOR DREDGING USING THIS CUTTER HEAD

(75) Inventor: Bruno Tack, Assenede (BE)

(73) Assignee: Dredging International N.V., Zwijndrecht (BE)

( * ) Notice: Subject to any disclaimer, the term of this patent is extended or adjusted under 35 U.S.C. 154(b) by 176 days.

(21) Appl. No.: 13/128,793

(22) PCT Filed: Nov. 11, 2009

(86) PCT No.: PCT/EP2009/064975

§ 371 (c)(1), (2), (4) Date: Aug. 1, 2011

(87) PCT Pub. No.: WO2010/055053

PCT Pub. Date: May 20, 2010

(65) Prior Publication Data

US 2011/0271561 A1 Nov. 10, 2011

(30) Foreign Application Priority Data

Nov. 12, 2008 (BE) ..... 2008/0610

(51) Int. Cl.

| | |
|---|---|
| ***E02F 3/92*** | (2006.01) |
| ***E02F 5/28*** | (2006.01) |
| ***E02F 9/06*** | (2006.01) |
| ***E02F 3/24*** | (2006.01) |

(Continued)

(52) U.S. Cl.

CPC ..... *E02F 9/062* (2013.01); *E02F 3/241* (2013.01); *E02F 3/905* (2013.01); *E02F 3/9212* (2013.01); *E02F 3/9237* (2013.01); *E02F 5/282* (2013.01); *E02F 9/2866* (2013.01)

(58) Field of Classification Search

CPC ..... E02F 5/282; E02F 9/062; E02F 9/2866; E02F 3/241; E02F 3/905; E02F 3/9212; E02F 3/9237

USPC ..... 37/342, 307, 326, 343, 337, 324

See application file for complete search history.

(56) References Cited

U.S. PATENT DOCUMENTS

| | | | | |
|---|---|---|---|---|
| 204,584 | A * | 6/1878 | Lee | 37/343 |
| 269,173 | A * | 12/1882 | Brown et al. | 37/343 |
| 281,883 | A * | 7/1883 | Johnson et al. | 37/343 |

(Continued)

FOREIGN PATENT DOCUMENTS

| | | | |
|---|---|---|---|
| BE | 1011787 | | 1/2000 |
| BE | 1016085 | A5 * | 2/2006 |

(Continued)

*Primary Examiner* — Thomas B Will

*Assistant Examiner* — Joan D Misa

(74) *Attorney, Agent, or Firm* — Novak Druce Connolly Bove + Quigg LLP

(57) ABSTRACT

A cutter head for dredging ground under water is disclosed. The cutter head is suitable for attachment to the ladder of a cutter suction dredger and for being moved through the ground therewith in a lateral sweeping movement. The cutter head includes a rotation-symmetrical revolving body which is rotatable around its rotation axis by means of drive means and which is provided along its peripheral surface with a number of cutting tools for penetrating into the ground, wherein the rotation axis of the cutter head runs substantially perpendicularly of the longitudinal direction of the ladder and substantially tangentially to the direction of the sweeping movement. Likewise, a method for breaking ground underwater, making use of the cutter head is shown.

11 Claims, 3 Drawing Sheets

(51) Int. Cl.
*E02F 3/90* (2006.01)
*E02F 9/28* (2006.01)

(56) References Cited

U.S. PATENT DOCUMENTS

| | | | | | |
|---|---|---|---|---|---|
| 366,468 | A | * | 7/1887 | Edwards et al. | 37/323 |
| 545,762 | A | * | 9/1895 | Bates | 37/330 |
| 551,962 | A | * | 12/1895 | Henderson | 37/343 |
| 660,956 | A | * | 10/1900 | Henderson | 37/329 |
| 810,810 | A | * | 1/1906 | Richardson | 37/343 |
| 876,790 | A | * | 1/1908 | Ermeling | 37/343 |
| 1,106,038 | A | * | 8/1914 | Fruhling | 37/323 |
| 1,619,850 | A | * | 3/1927 | Casey | 37/320 |
| 3,516,712 | A | | 6/1970 | Bennett et al. | |
| 3,724,901 | A | * | 4/1973 | Rollins | 299/84.1 |
| 3,739,503 | A | * | 6/1973 | Barker et al. | 37/308 |
| 3,962,803 | A | * | 6/1976 | O'Brien | 37/319 |
| 4,095,545 | A | * | 6/1978 | Vaughn et al. | 114/26 |
| 4,102,064 | A | * | 7/1978 | Pot | 37/310 |
| 4,150,502 | A | * | 4/1979 | Sijthoff | 37/333 |
| 4,267,652 | A | | 5/1981 | Senesac | |
| 4,344,239 | A | | 8/1982 | Verboom | |
| 4,470,210 | A | * | 9/1984 | Hahn | 37/328 |
| 4,702,024 | A | * | 10/1987 | Shiba et al. | 37/327 |
| 5,060,404 | A | * | 10/1991 | Lipford | 37/326 |
| 6,003,952 | A | * | 12/1999 | Smart et al. | 299/9 |
| 6,085,446 | A | * | 7/2000 | Posch | 37/343 |
| 6,543,963 | B2 | * | 4/2003 | Bruso | 405/128.15 |
| 6,578,294 | B2 | * | 6/2003 | Ollinger, IV | 37/327 |
| 6,779,948 | B2 | * | 8/2004 | Bruso | 405/128.75 |
| 8,186,764 | B2 | * | 5/2012 | Johnson et al. | 299/64 |
| 8,240,776 | B2 | * | 8/2012 | Plumley | 299/75 |
| 2002/0012572 | A1 | | 1/2002 | Bruso | |
| 2012/0000712 | A1 | * | 1/2012 | Claessens | 175/412 |
| 2012/0272552 | A1 | * | 11/2012 | Tack | 37/328 |

FOREIGN PATENT DOCUMENTS

| | | | |
|---|---|---|---|
| EP | 0226660 | | 7/1987 |
| GB | 1383089 | | 2/1975 |
| GB | 1567198 | | 5/1980 |
| JP | 59194674 | | 11/1984 |
| JP | 62225631 | | 10/1987 |
| JP | 02128027 | A * | 5/1990 |
| JP | 30001632 | | 1/1991 |

* cited by examiner

CUTTER HEAD FOR DREDGING GROUND AND METHOD FOR DREDGING USING THIS CUTTER HEAD

FIELD OF THE INVENTION

The invention relates to a cutter head for dredging ground under water, this cutter head being suitable for attachment to the ladder of a cutter suction dredger and for being moved over the ground therewith in a lateral sweeping movement.

BACKGROUND OF THE INVENTION

Such a cutter head (also referred to as cutter) is for instance known from NL-A-9200368. Described in NL-A-9200368 is a cutter head in the form of a rotation-symmetrical revolving body which is rotatable about a rotation axis by means of drive means and which is provided along its peripheral surface with a number of cutting tools for penetrating into the ground. The cutter head is connected to a suction conduit for discharging the loosened ground. The known revolving body takes a conical form and comprises a number of spiral-shaped ribs running between two circular end sides. The spiral-shaped ribs are provided with cutting tools. The rotation axis of the known cutter head runs substantially parallel to the longitudinal direction of the ladder to which it is attached. A similar cutter dredger is disclosed in JP 61112065.

The cutter head is applied in combination with a cutter suction dredger (also referred to as cutter dredger). Such a cutter suction dredger comprises a ship anchored in the ground by means of spud posts. This anchoring creates a means for absorbing and transmitting to the ground the generally considerable reaction forces occurring during dredging. The ladder here forms a substantially rigid connection between the cutter head and the cutter suction dredger. In order to enable removal of the dredged ground a suction conduit, which is connected to the cutter head, is usually fixed to the ladder. During dredging the cutter head with ladder and suction conduit is usually lowered into the water at a generally oblique angle until it touches the ground. The cutter head is then set into rotation and dragged through the ground by hauling the ladder alternately from port side to starboard side using winches. The cutter head hereby makes a lateral sweeping movement through the ground. By rotating the cutter head round the rotation axis the cutting tools strike the ground with great force with their tips under the weight of the cutter head, ladder and suction conduit. The ground is eventually broken into large fragments by the repetitive hammer blows of the successive cutting tools. These fragments are suctioned up by the suction conduit and discharged. A whole ground surface can be dredged by moving the cutter suction dredger over a determined distance at a time and repeating the above stated sweeping movement.

In order to protect the cutting tools to some extent from excessive wear, the rotation speeds of the known cutter head are generally limited to 20 to 40 rotations/minute. This has the drawback that the efficiency of the dredging operation, particularly in the case of (hard) grounds with a high Unconfined Compressive Strength (UCS) is often insufficient. Efficiency is understood in the context of this application to mean the volume of ground which can be dredged per unit of time and unit of power.

SUMMARY OF THE INVENTION

The present invention has for its object to provide a cutter head for a cutter suction dredger which, in addition to other advantages, requires a reduced power to dredge ground surfaces and which also makes it technically possible to dredge harder types of ground in a more efficient manner.

According to the invention, for this purpose a cutter head is provided for dredging ground under water, said cutter head being attached to the ladder of a cutter suction dredger, which ladder is adapted to be hauled alternately from port side to starboard side using winches, whereby the cutter head is moved through the ground in a lateral sweeping movement, which cutter head comprises a rotation-symmetrical revolving body which is rotatable around its rotation axis by means of drive means and which is provided along its peripheral surface with a number of cutting tools for penetrating into the ground, the attachment being such that the rotation axis of the cutter head runs substantially perpendicular to the longitudinal direction of the ladder. Surprisingly, an improved efficiency is obtained in that the rotation axis of the cutter head runs substantially perpendicularly of the longitudinal direction of the ladder (or substantially tangentially to the direction of the sweeping movement). The known cutter head generally rotates in one rotation direction. In the case of a clockwise rotation direction (as seen from the ladder) the cutting tools will, as the ladder and cutter head sweep to starboard, penetrate into the ground with their cutting side above the rotation axis (in the manner of an axe). This is also referred to as overcutting. As the ladder and cutter head sweep to the port side, the cutting tools will however penetrate into the ground with their cutting side below the rotation axis (in the manner of a shovel). This is also referred to as undercutting. Depending on the sweep direction, the known cutter head thus breaks the ground in different ways, and so also with differing efficiency. The cutter head according to the invention does not have this drawback and provides the option of breaking the ground in the same manner in both directions, and of thus obtaining the same efficiency. It is expected that this will result in an increase in the average efficiency per sweep stroke compared to the known cutter head.

It should be noted that BE 1016085 describes a drag head comprising a rotation-symmetrical revolving body which is rotatable around its rotation axis by means of drive means and which is provided along its peripheral surface with a number of cutting tools for penetrating into the ground. The drag head of BE 1016085 however is used in a trailing suction hopper dredger such that its rotation axis is always perpendicular to the direction of dredging.

JP 62225631 discloses a trailing suction hopper dredger with a drum cutter that rakes the bottom. As in BE 1016085, the rotation axis of the drum cutter is in operation always perpendicular to the dredging direction.

Because the rotation axis of the cutter head runs substantially tangentially to the direction of the sweeping movement a better cutting of the cutter head into the ground is moreover obtained, thereby further improving the dredging efficiency. The rotation axis of the cutter head running substantially perpendicular to the longitudinal direction of the ladder (or running substantially tangentially to the direction of the sweep movement) is understood to mean that the rotation axis of the cutter head according to invention makes an angle with the longitudinal direction of the ladder which differs by no more than 20% from an angle of 90 degrees, more preferably by no more than 10% and most preferably by no more than 5%. During the sweeping of the cutter head the rotation axis of the cutter head according to the invention will otherwise run substantially parallel to the ground surface.

It is advantageous to characterize the cutter head according to invention in that the revolving body of the cutter head is symmetrical relative to a central plane and is provided on at least both end sides with cutting tools. A further symmetry is hereby achieved during dredging, wherein there is substantially no longer any difference between dredging with a port sweep or dredging with a starboard sweep. The cutter head preferably comprises a cylindrical revolving body provided on both end sides with spherical segments on which the cutting tools are arranged.

Because a wholly different cutting mechanism is applied according to the invention, the cutting tools are preferably also embodied other than existing cutting tools. It is advantageous to provide the cutter head according to the invention with rotation-symmetrical cutting tools (also referred to in the present application as bits) which are still more preferably received in holders arranged along the peripheral surface of the revolving body. The preferred bits are smaller than the known cutting tools so that they can be placed at smaller mutual distances on the jacket surface of the cutter head. The rotation-symmetrical cutting tools according to the invention, which are preferably relatively small compared to the known cutting tools, break the ground with relatively little force and with a relatively low penetration. Because the number of cutting tools that can be arranged on the peripheral surface of the cutter head is relatively great, breaking can take place with improved efficiency and moreover more uniformly. A further advantage of the present embodiment is that the ground chippings formed by the breaking will generally be relatively small compared to the fragments produced with the known cutter head, whereby they can be easily suctioned up by the suction conduit. This further increases the dredging efficiency.

If desired, a plurality of cutting tools can be arranged in the peripheral direction of the cutter head. It is advantageous here for the cutting tools to be distributed regularly in the peripheral direction over the revolving body. The peak loads which occur are hereby reduced, this resulting in a smoother operation of the cutter head. A smoother operation is further enhanced by providing a cutter head with elongate revolving body and also distributing the cutting tools regularly over the revolving body in the longitudinal direction of the cutter head. It is also advantageous to make the holders for the cutting tools displaceable so that a high degree of flexibility is achieved in respect of placing of the cutting tools, wherein the embodiment of the cutter head can be adapted in simple manner to the requirements of the ground characteristics.

The cutter head according to the invention preferably comprises cutting tools with relatively small dimensions compared to the known cutting tools. A suitable overall length of a cutting tool preferably amounts to between 20 and 400 mm. Suitable transverse dimensions preferably amount to between 10 and 100 mm. In a preferred embodiment the cutting tools have a length protruding outside the holder (the active length) lying between 10 and 500 mm. The active length of the cutting tools more preferably lies between 20 and 250 mm, and most preferably between 50 and 150 mm. During operation the known cutter head generally only strikes against the ground surface momentarily with one cutting tool. This results in a rapid wear of the cutting tools because the full impact force developed by the produced torque has to be borne by only one cutting tool. The cutter head according to the invention has the additional advantage that a plurality of the cutting tools distributed over the revolving surface of the revolving body—owing to their relatively small dimensions—can be simultaneously in contact with the ground, whereby they will be less susceptible to wear. It is moreover possible to keep substantially constant the number of cutting tools that are simultaneously in contact with the ground, so that the force exerted per cutting tool on the ground remains substantially constant during dredging.

The mutual distance between the cutting tools is determined, among other factors, by the dimensions of the cutting tools themselves and by the overall underwater weight of the cutter head, the ladder and other components. The hauling force developed can also be of importance. In addition, the properties of the ground for dredging are important, for instance the compression strength/tensile strength ratio of the ground. It has been found that a further improvement in efficiency is obtained by a cutter head wherein the intermediate distance in rotation direction between two successive cutting tools is a maximum of ten times the penetration depth of the cutting tools into the rock, and still more preferably a maximum of five times the penetration depth of the cutting tools.

The cutting tools can in principle be positioned in all possible ways in the longitudinal direction of the cutter head (the direction perpendicular to the direction of the ladder). In order to further increase the dredging efficiency it is advantageous to arrange adjacent cutting tools offset relative to cutting tools situated further along in the longitudinal direction. A greater working width is hereby covered.

Another preferred embodiment of the cutter head according to the invention is characterized in that the cutter head comprises jet pipes for injecting a liquid, preferably water, under high pressure. High pressure is understood to mean pressures amounting preferably to 1500 bar, more preferably 2000 bar, most preferably 2500 bar. The efficiency of the cutting tools is hereby further increased. The jet pipes can in principle be disposed according to the invention in front of, behind or at the position of the cutting tools. It is also possible to provide the cutting tools themselves with jet pipes. These are then embodied for instance as a central bore. The jet pipes can already assist in discharging broken ground parts via the suction conduit, and/or in further reducing in size and/or fluidizing these ground parts. It is also possible for the jet pipes to assist in removing softer ground layers from ground that has not yet been broken, so that a better defined ground surface is created into which the cutting tools can penetrate better. Jet pipes arranged in a cutting tool have the advantage that liquid under high pressure can penetrate into already partially formed cracks, and can therefore accelerate breaking of the ground. This will possibly also reduce wear of the cutting tools.

For effective operation the known cutter head must be pressed with great force against the ground by the ladder. If the force is too small, the cutting tools will then obtain insufficient grip on the ground, whereby the cutter head will move only superficially over the ground and not break it sufficiently. Owing to the required high pressure force the connection between cutter head and cutter suction dredger is necessarily rigid. It is hereby not possible to use the known cutter head in bad weather. The ladder will be exposed to excessive pressure forces due to the swell. Because the cutter head according to the invention has a different operating principle, the pressure force required is lower. This provides the option of preferably providing the cutter head according to the invention with a revolving body connected by means of a spring connection to the ladder. By disposing the cutter head in spring-mounted manner relative to the ladder and/or cutter suction dredger a possible vertical and/or horizontal displacement of the cutter suction dredger caused by swell can be readily compensated by the spring-mounted connection. This makes it possible to continue working even in bad weather, this resulting in a considerable economic advantage.

The invention also relates to a method for dredging ground under water with a cutter suction dredger equipped with a cutter head according to the invention. In the method the cutter head is attached to the ladder of the cutter suction dredger and moved through the ground therewith in a lateral sweeping movement by means of a winch, wherein the cutter head rotates and the cutting tools make contact with the ground, and penetrate at least partially therein under the weight of the ladder and the cutter head and the tensile force exerted by the winch. The ground is hereby broken, after which the broken ground portions are suctioned up by a suction conduit. It is advantageous when the method is characterized in that water under high pressure is injected into the ground. The advantages of the method have already been elucidated with reference to the description of the cutter head, and are not further repeated here.

BRIEF DESCRIPTION OF THE DRAWINGS

The invention will now be further elucidated on the basis of the following figures and description of preferred embodiments, without the invention otherwise being limited thereto. The figures are not necessarily drawn to scale. In the figures.

DETAILED DESCRIPTION

Figure 1:
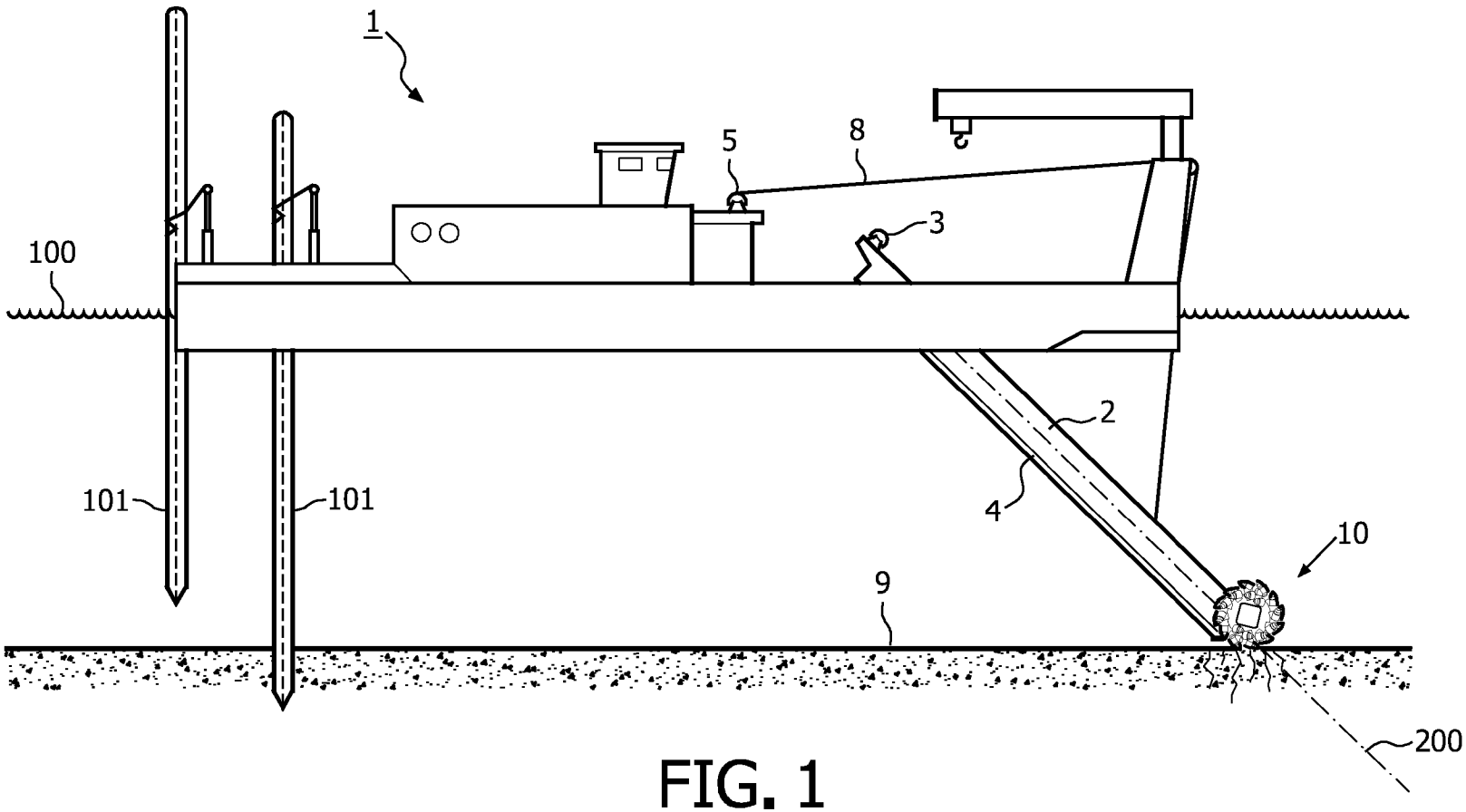
FIG. 1 is a schematic side view of a part of a cutter suction dredger with a ladder attached thereto and provided with a cutter head according to the invention.

FIG. 1 shows a cutter suction dredger 1 on which a ladder 2 is mounted pivotally around a horizontal shaft 3. Ladder 2 is provided with a suction pipe 4 which can suction up the loosened ground parts to a level above water surface 100, after which they are discharged. Ladder 2 is hauled over the ground surface 9 for dredging or breaking by means of a winch 5 which is arranged on the deck of cutter suction dredger 1 and is provided with a number of winch cables 8. Ladder 2 is provided on the outer end thereof with a cutter head 10 according to the invention. Cutter head 10 can be lowered under water by means of winch cables 8 and moved during use over ground surface 9 in a reciprocating, sweeping movement from the port side to the starboard side of cutter suction dredger 1 and back. In order to be able to absorb the forces generated here on the ground surface, cutter suction dredger 1 is anchored in the ground by means of a spud post 101. FIG. 1 shows the left-hand spud post in unanchored position and the right-hand spud post in anchored position.

Figure 2:
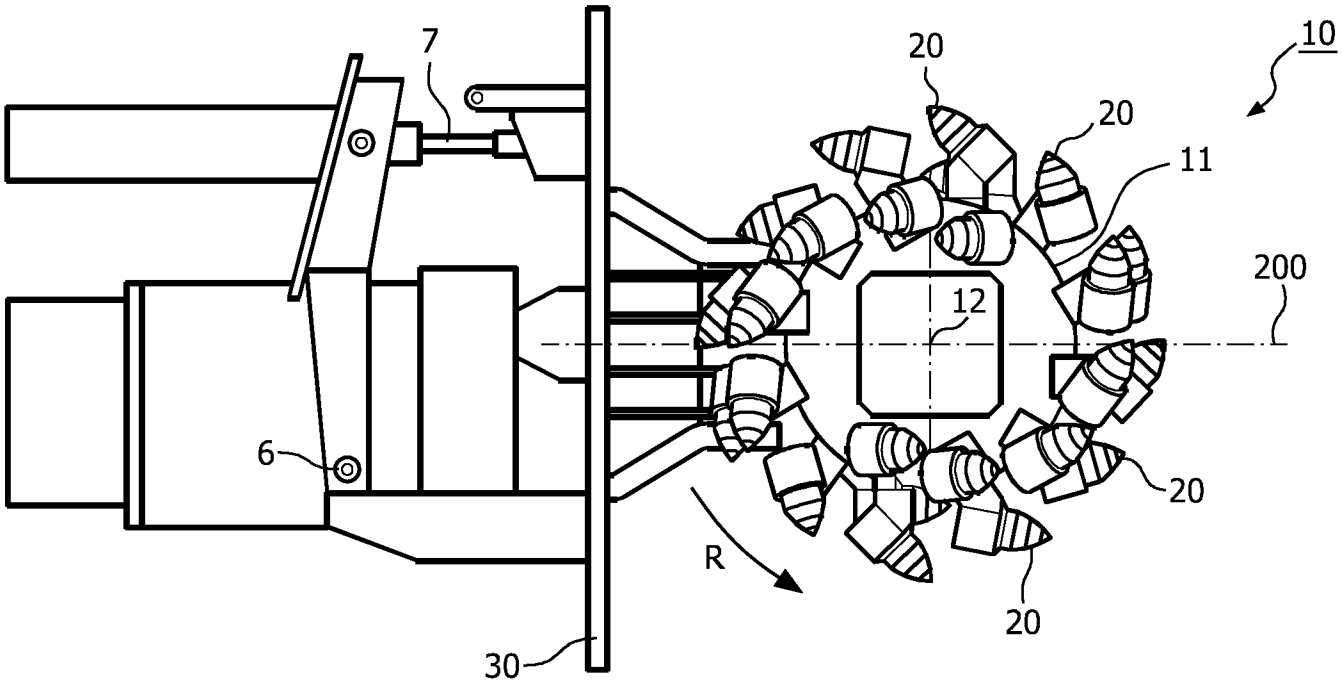
FIG. 2 is a schematic side view of a cutter head according to the invention.

Referring to FIG. 2, cutter head 10 according to the invention comprises a rotation-symmetrical revolving body 11 which can be set into rotation around its rotation axis 12 by means of drive means (not shown). In the shown embodiment revolving body 11 is set into rotation in the indicated counter-clockwise direction R. Along the peripheral surface the revolving body 11 is provided with the number of cutting tools 20 which in operation can penetrate into the ground 9. According to the invention the rotation axis 12 of cutter head 10 runs substantially perpendicularly of the longitudinal direction 200 of ladder 2. In the shown embodiment cutter head 10 is connected pivotally to ladder 2 via a pressure plate 30 by means of pivot connection 6. In this way the position of cutter head 2 relative to ground 9 can be set largely independently of the angle of ladder 2 to ground 9. Cutter head 10 can be rotated around the pivoting connection 6 by means of hydraulic cylinder 7.

Figure 3:
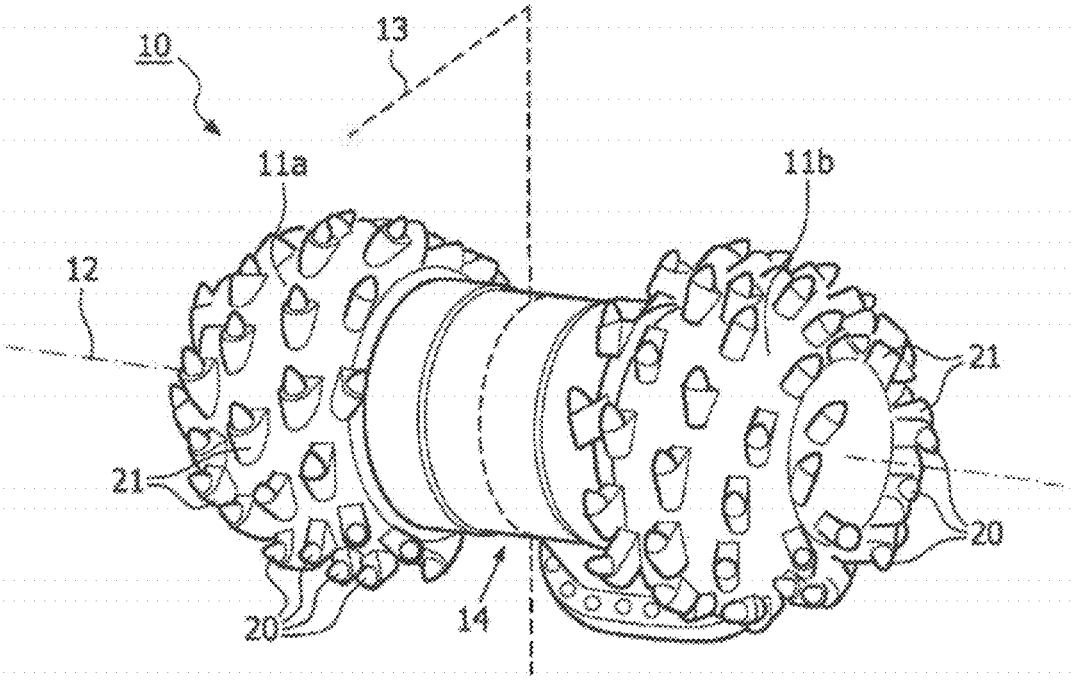
FIG. 3 is a schematic perspective view of the cutter head of FIG. 2.

In a preferred embodiment revolving body 11 of cutter head 10 is plane-symmetrical and provided with the cutting tools 20 on both end sides, as shown in FIG. 3. In this embodiment revolving body 11 is formed by two parts 11*a* and 11*b* situated on either side of a central stationary part 14 with which cutter head 10 is mounted on ladder 2. In the context of this application plane-symmetrical is understood to mean that cutter head 2 displays symmetry relative to a plane of symmetry 13 running perpendicularly of the rotation axis 12. The revolving bodies (11*a*, 11*b*) disposed on both end sides each comprise a jacket surface provided with holders 21 in which cutting tools 20 are received. Cutting tools 20 can in principle make any angle with the jacket surface. The angle chosen depends, among other factors, on the design of the revolving bodies, the characteristics of the ground and the maximum allowable reaction forces. Owing to the plane symmetry of the present preferred variant the cutter head 10 will break the ground in the same manner irrespective of the direction of sweep of ladder 2. Sweeping from port to starboard, or vice versa, gives essentially the same result, this enhancing the average efficiency per sweep stroke.

Figure 4:
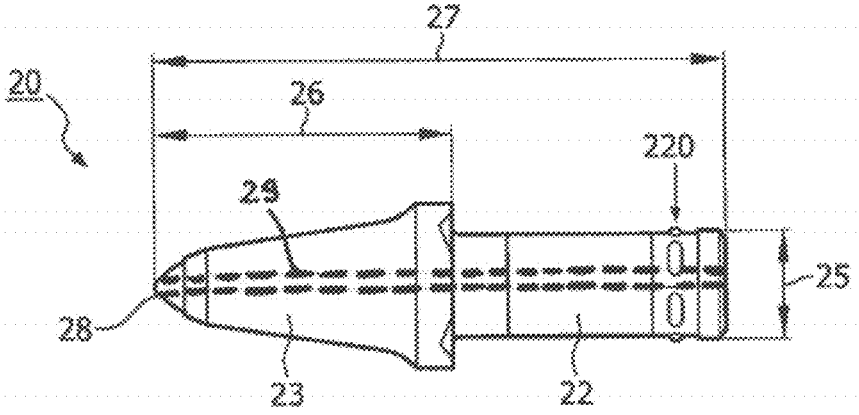
FIG. 4 is a side view of a detail of a cutting tool according to the invention.

Referring to FIG. 4, a rotation-symmetrical cutting tool 20 is shown. Such a cutting tool 20 is recommended, although cutting tool 20 can in principle take any form suitable for breaking ground under water. A cutting tool 20 according to the present embodiment with overall length 27 comprises a substantially cylindrical part 22 with diameter 25 and a bit-like second part 23. Cutting tool 20 can be arranged with cylindrical part 22, for instance by means of snap connection 220, in a holder 21 of revolving body 11. A permanent connection is also possible, or another form of releasable connection. In the position of cutting tool 20 arranged in holder 21 the bit-like part 23 will protrude outside the holder over an active length 26. The bit-like part 23 of cutting tool 20 is provided with a hardened tip 28 at the outer end which comes into contact with the ground.

The cutter head according to the invention applies an improved cutting principle compared to the known cutter head. Cutting tools 20 according to the present preferred variant are preferably smaller than the known cutting tools. Typical overall lengths 27 amount to between 20 and 400 mm, although this must not be interpreted as being limitative. Such cutting tools break the ground 9 with relatively little force and with relatively low penetration. Because the number of cutting tools 20 arranged on revolving body 11 of cutter head 10 is relatively large when compared to the known cutter head, breaking can take place with undiminished efficiency, and moreover more uniformly. The length 26 (the active length) of cutting tools 20 which protrudes outside holder 21 lies in a preferred variant between 20 and 250 mm, and more preferably between 50 and 150 mm. Cutting tools 20 are distributed regularly over revolving body 11 (or parts 11*a* and 11*b* thereof) in the rotation direction R. The intermediate distance in rotation direction R between two successive cutting tools 20 is preferably a maximum of ten times the penetration depth of cutting tools 20, and more preferably a maximum of five times the penetration depth. Cutter head 10 is preferably also provided with jet pipes (not shown) for injecting water under high pressure. The jet pipes are advantageously arranged in a cutting tool 20 as centrally running bore.

Cutter head 10 according to the invention is particularly suitable for use in a method for dredging ground under water with a cutter suction dredger 1. Cutter head 10 is moved for this purpose through the ground 9 in a lateral sweeping movement by means of winch 5, wherein cutter head 10 is also set into rotation around rotation axis 12. Cutting tools 21 in this way strike ground 9 repeatedly, wherein they penetrate at least with tip 28 of the bit-like part 23 into the ground under the weight of ladder 2 and cutter head 10 and the tensile force exerted by winch 5. Ground 9 is hereby broken with good efficiency. The broken ground portions are suctioned up by suction conduit 4.

The invention claimed is:

1. Cutter head for dredging ground under water, said cutter head being attached to a ladder of a cutter suction dredger, which said cutter suction dredger is anchored to the ground by a spud post that transmits considerably reaction forces occurring during dredging to the ground, and around which said spud post said ladder is hauled alternately from port side to starboard side using winches, such that the cutter head is moved through the ground in a lateral sweeping movement around said spud post, which said cutter head comprises a rotation-symmetrical revolving body which is rotatable around its rotation axis by a drive and which is provided along its peripheral surface with a number of cutting tools for penetrating into the ground, wherein an attachment of said cutter head to said ladder is such that the rotation axis of the cutter head runs substantially perpendicular to the longitudinal direction of the ladder and tangential to the sweeping movement, wherein the revolving body comprises a plane-symmetrical cylindrical body, spherical segments are provided on both end sides of the cylindrical body, and the cutting tools are arranged on said spherical segments, wherein the active length of the cutting tools protruding outside a holder for the cutting tools lies between 20 and 250 mm.

2. Cutter head as claimed in claim 1, wherein the cutting tools runs substantially tangentially to a jacket surface of the cutter head.

3. Cutter head as claimed in claim 1, wherein the cutting tools are received in holders arranged along the peripheral surface of the revolving body.

4. Cutter head as claimed in claim 1, wherein the cutting tools are rotation-symmetrical.

5. Cutter head as claimed in claim 1, wherein the length of the cutting tools protruding outside the holder (the active length) lies between 50 and 150 mm.

6. Cutter head as claimed in claim 1, wherein the cutting tools are distributed regularly in the rotation direction over the revolving body.

7. Cutter head as claimed in claim 6, wherein the intermediate distance in rotation direction between two successive cutting tools is a maximum of ten times the penetration depth of the cutting tools into the ground.

8. Cutter head as claimed in claim 7, wherein the intermediate distance in rotation direction between two successive cutting tools is a maximum of five times the penetration depth of the cutting tools into the ground.

9. Cutter head as claimed in claim 7, wherein the cutter head comprises jet pipes for injecting water under high pressure.

10. A method for dredging ground under water comprising the steps of:

providing a cutter suction dredger equipped with a cutter head, said cutter head being attached to a ladder of said cutter suction dredger, which said cutter suction dredger is anchored to the ground by a spud post that transmits considerably reaction forces occurring during dredging to the ground, and around which said spud post said ladder is hauled alternately from port side to starboard side using winches, whereby said cutter head is moved through the ground in a lateral sweeping movement around said spud post, which said cutter head comprises a rotation-symmetrical revolving body which is rotatable around its rotation axis by a drive and which is provided along its peripheral surface with a number of cutting tools for penetrating into the ground, an attachment of said cutter head to said ladder is such that the rotation axis of the cutter head runs substantially perpendicular to the longitudinal direction of the ladder; wherein the revolving body comprises a plane-symmetrical cylindrical body, spherical segments are provided on both end sides of the cylindrical body, and the cutting tools are arranged on said spherical segments, wherein the active length of cutting tools protruding outside the holder lies between 20 and 250 mm;

attaching the cutter head to the ladder of the cutter suction dredger and moving through the ground therewith in a lateral sweeping movement by means of a winch, wherein the cutter head rotates and the cutting tools make contact with the ground, and penetrate at least partially therein under the weight of the ladder and the cutter head and the tensile force exerted by the winch, whereby the ground is broken and wherein the broken ground portions are suctioned up by a suction conduit.

11. A method as claimed in claim 10, wherein said cutter head comprises jet pipes for injecting water under high pressure, and water under high pressure is injected into the ground.

* * * * *